US010076848B2

(12) United States Patent
Bergquist

(10) Patent No.: US 10,076,848 B2
(45) Date of Patent: Sep. 18, 2018

(54) BATTERY POWERED REAR HANDLE CHAIN SAW

(75) Inventor: Oskar Bergquist, Huskvarna (SE)

(73) Assignee: HUSQVARNA AB, Huskvarna (SE)

( * ) Notice: Subject to any disclaimer, the term of this patent is extended or adjusted under 35 U.S.C. 154(b) by 51 days.

(21) Appl. No.: 14/239,429

(22) PCT Filed: Aug. 26, 2011

(86) PCT No.: PCT/SE2011/051031
§ 371 (c)(1),
(2), (4) Date: Feb. 18, 2014

(87) PCT Pub. No.: WO2013/032375
PCT Pub. Date: Mar. 7, 2013

(65) Prior Publication Data

US 2014/0215838 A1 Aug. 7, 2014

(51) Int. Cl.
*B27B 17/02* (2006.01)
*B27B 17/00* (2006.01)
*B25F 5/02* (2006.01)

(52) U.S. Cl.
CPC ..... *B27B 17/0008* (2013.01); *B25F 5/02* (2013.01); *B27B 17/02* (2013.01)

(58) Field of Classification Search
CPC . B27B 17/00; B27B 17/0008; B27B 17/0083; B27B 17/02; B25F 5/02; A01G 3/086
(Continued)

(56) References Cited

U.S. PATENT DOCUMENTS 2,714,406 A * 8/1955 Smith ..... B27B 17/02 30/123.4
4,272,889 A * 6/1981 Scott et al. ..... 30/371
(Continued)

FOREIGN PATENT DOCUMENTS

EP 2223780 A2 9/2010
JP 01069769 A * 3/1989 ..... F02M 31/08
JP 2003251602 A 9/2003

OTHER PUBLICATIONS

WG206 20inch 120V Electric Hedge Trimmer, printed from http://www.outdoordistributors.com/Worx/pages/WRS-WG206.html on May 24, 2011, all enclosed pages cited.
(Continued)

*Primary Examiner* — Ghassem Alie
*Assistant Examiner* — Samuel A Davies
(74) *Attorney, Agent, or Firm* — McNair Law Firm, P.A.

(57) ABSTRACT

A battery-powered chain saw is provided which chain saw comprises a housing (10) extending in a longitudinal direction (X) between a front end (12) and a rear end (11), a rear handle (20) fixedly connected to or integral with the housing (10) and extending in the longitudinal direction (X), a front handle (30) fixedly connected to the housing (10) and an electric motor (40) arranged to drive a cutting element of the chain saw, the electric motor having a motor rotation axis (A1). The chain saw has a longitudinal rotation axis (X1). It is characterized in that a point (60) in which a center axis (A2) of an upper portion (31) of the front handle (30) intersects a vertical plane (P) comprising the longitudinal rotation axis (X1) of the chain saw, is positioned rearwardly of a point (70) in which the motor rotation axis (A1) intersects said vertical plane (P).

12 Claims, 2 Drawing Sheets

(58) Field of Classification Search
USPC ..... 30/381, 383; 429/99
See application file for complete search history.

(56) References Cited

U.S. PATENT DOCUMENTS

| | | | | | |
|---|---|---|---|---|---|
| 4,382,334 | A * | 5/1983 | Reynolds | 30/386 | |
| 4,555,849 | A * | 12/1985 | Ando | B27B 9/00 | 30/388 |
| 6,016,604 | A * | 1/2000 | Wolf | B25F 5/006 | 30/382 |
| D481,601 | S * | 11/2003 | Ashfield | B27B 17/02 | D8/65 |
| 7,275,322 | B2 | 10/2007 | Stones | | |
| 2004/0098869 | A1* | 5/2004 | Ashfield | B27B 17/02 | 30/383 |
| 2007/0000138 | A1* | 1/2007 | Baskar et al. | 30/392 | |
| 2009/0241350 | A1* | 10/2009 | Lau | 30/199 | |
| 2010/0218386 | A1* | 9/2010 | Rosskamp et al. | 30/277.4 | |

OTHER PUBLICATIONS

International Search Report and Written Opinion of PCT/SE2011/051031 dated Apr. 3, 2012, all enclosed pages cited.

Chapter I International Preliminary Report on Patentability of PCT/SE2011/051031 dated Mar. 4, 2014, all enclosed pages cited.

* cited by examiner

BATTERY POWERED REAR HANDLE CHAIN SAW

TECHNICAL FIELD

This invention relates to battery-powered chain saws. Especially, the invention deals with a battery-powered chain saw having a rear handle and a front handle.

BACKGROUND OF THE INVENTION

Battery-powered chain saws are well known in the art.

However, there remains a need for battery-powered chain saws targeted for demanding consumers and professional users, having high expectations regarding the performance as well as the maneuverability of the saws.

In order to satisfy these high expectations saws provided with powerful high energy batteries that last long and have a quick recharging possibility are required. At the same time, the saws should be comfortable to carry and maneuver, such that they can be used for long and uninterrupted work.

Hence, there is a need for a battery-powered chain saw which provides a possibility to combine high performance and satisfactory ergonomic features.

SUMMARY OF THE INVENTION

It is an object of the present invention to provide a battery powered chain saw which is comfortable to carry and operate and which may comprise high capacity components.

According to an aspect of the solution, this object is at least partly achieved by means of a battery-powered chain saw comprising a housing extending in a longitudinal direction between a front end and a rear end, a rear handle fixedly connected to or integral with the housing and extending in the longitudinal direction, a front handle fixedly connected to the housing, an electric motor arranged to drive a cutting element of the chain saw, the electric motor having a motor rotation axis. The chain saw has a longitudinal rotation axis and is characterized in that a point, in which a center axis of an upper portion of the front handle intersects a vertical plane comprising the longitudinal rotation axis of the chain saw, is positioned rearwardly of a point in which the motor rotation axis intersects said vertical plane.

By configuring the chain saw in this way a favorable distribution of masses may be achieved within the chain saw even a rater heavy battery pack is used. Since the high capacity batteries required for professional use of the saw tend to be heavy, such a configuration is particularly favorable in chain saws where high capacity batteries are needed. As a result, battery-powered chain saws for demanding users may be manufactured, which chain saws are comfortable to carry and maneuver.

According to an embodiment, the vertical plane comprising the longitudinal rotation axis also comprises a longitudinal center line of the rear handle.

According to another embodiment, the vertical plane comprising the longitudinal rotation axis of the chain saw is essentially parallel with a main extension plane of a cutting element supporting guide bar extending from the front end of the housing.

According to yet another embodiment, the upper portion of the front handle extends in an essentially transversal direction of the chain saw.

According to another embodiment, the motor rotation axis extends in a direction which is essentially parallel with the transversal direction of the chain saw.

DEFINITIONS

As used herein, the following terms have the following meanings:

The vertical direction is a direction perpendicular to a support surface on which the saw body may be positioned, i.e. the Y direction in the drawings. The support surface extends in a lateral plane which is shown as the XZ-plane in the drawings.

The terms upwards and downwards are based on a normal working position of the saw.

The front end of the saw is the end distal to an operator during normal use of the saw.

Correspondingly, the rear end is the end proximal to the operator during normal use.

The longitudinal direction is shown as the X direction in the drawings, whereas the transversal direction is shown as the Z direction in the drawings.

The terms left and right are defined based on an operator holding the saw in an operating position.

BRIEF DESCRIPTION OF THE DRAWINGS

The invention will be understood and appreciated more fully from the following detailed description, taken in conjunction with the drawings, in which.

DESCRIPTION OF PREFERRED EMBODIMENTS

Figure 1:
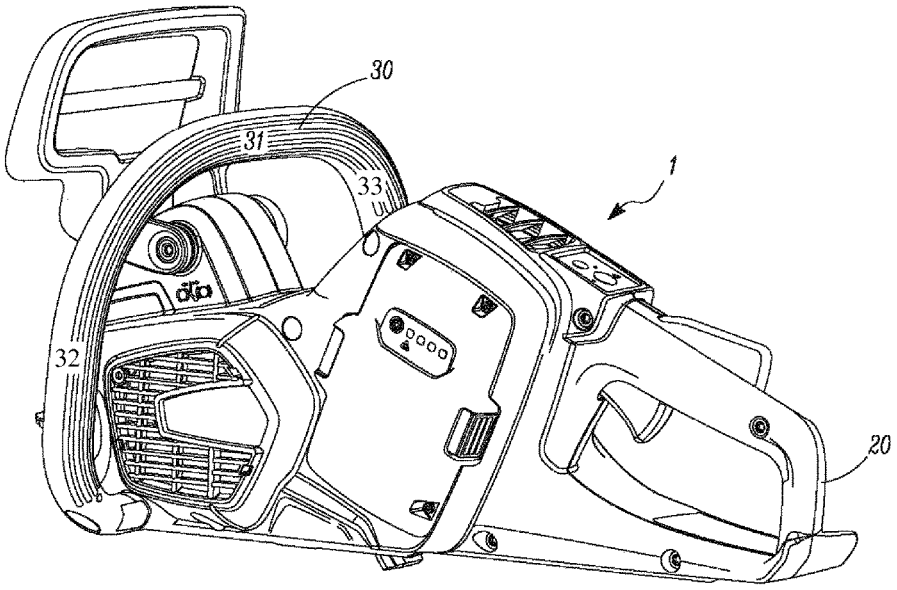
FIG. 1 is a partial perspective view of a battery-powered rear handle chain saw according to an embodiment of the invention.

The present invention will be described more fully hereinafter with reference to the accompanying drawings, in which preferred embodiments of the invention are shown. The invention may, however, be embodied in many different forms and should not be construed as limited to the embodiments set forth herein; rather these embodiments are provided so that this disclosure will be thorough and complete, and will fully convey the scope of the invention to those skilled in the art. In the drawings, like numbers refer to like elements.

Referring to FIG. 1, a major part of a battery-powered chain saw 1 according to embodiments herein is shown. The saw has a main handle 20 in the form of a rear handle 20 and a support handle 30 in the form of a front handle 30.

Figure 2:
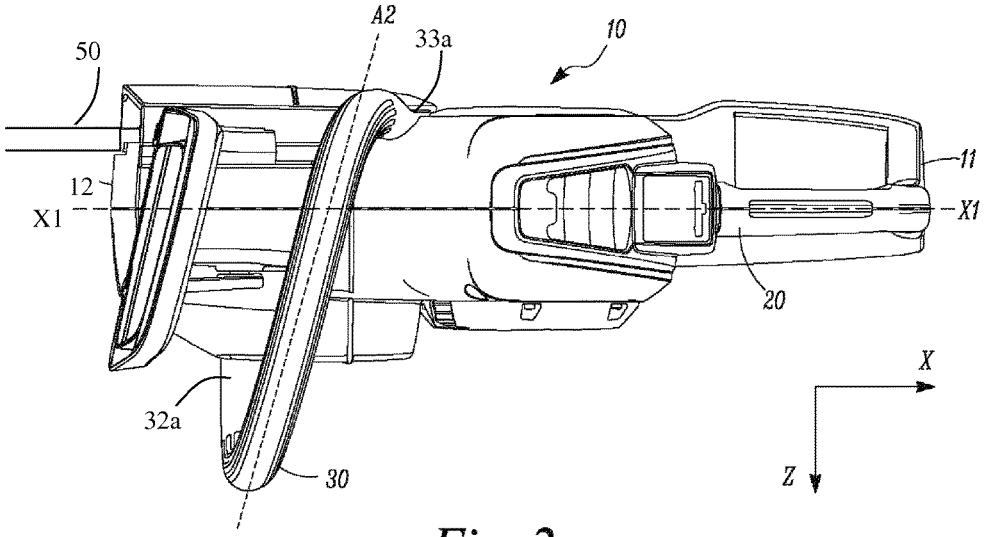
FIG. 2 is a partial top view of a battery-powered rear handle chain saw according to an embodiment of the invention.

The saw 1 has a body portion 10 to which the handles 20, 30 and a chain guiding bar 50 are connected. The guide bar 50 is partially shown in FIG. 2, whereas it is omitted in FIGS. 1 and 3*a*-3*b*. The front end of the guide bar 50 is omitted in FIG. 2. The guide bar extends from a front end 12 of the body portion 10, in a longitudinal direction of the saw.

The body portion 10 extends between a front end 12 and a rear end 11.

The guide bar is arranged to support a saw chain, which is not shown in the figures.

The rear handle 20 extends in the longitudinal direction X of the saw.

The front handle according to the figures has an essentially U-shaped configuration, with an upper portion 31, interconnecting a left leg portion 32 and a right leg portion 33, as seen from an operator's point of view. The leg portions are connected to the body portion 10 in their lower ends 32*a*, 33*a*.

The upper portion 31 of the front handle 30 shown in the figures is configured such that an imaginary center axis A2 of the portion 31 extends in a direction which is parallel with the XZ plane. As an alternative, the center axis may be slightly angled relative to the XZ-plane.

In the embodiment shown in the figures, the center axis A2 of the upper portion 31 is angled relative to the Z direction shown in the figures, i.e. relative to the transversal direction.

In alternative embodiments, the center axis of the upper portion may extend in the transversal direction Z.

Figure 3A:
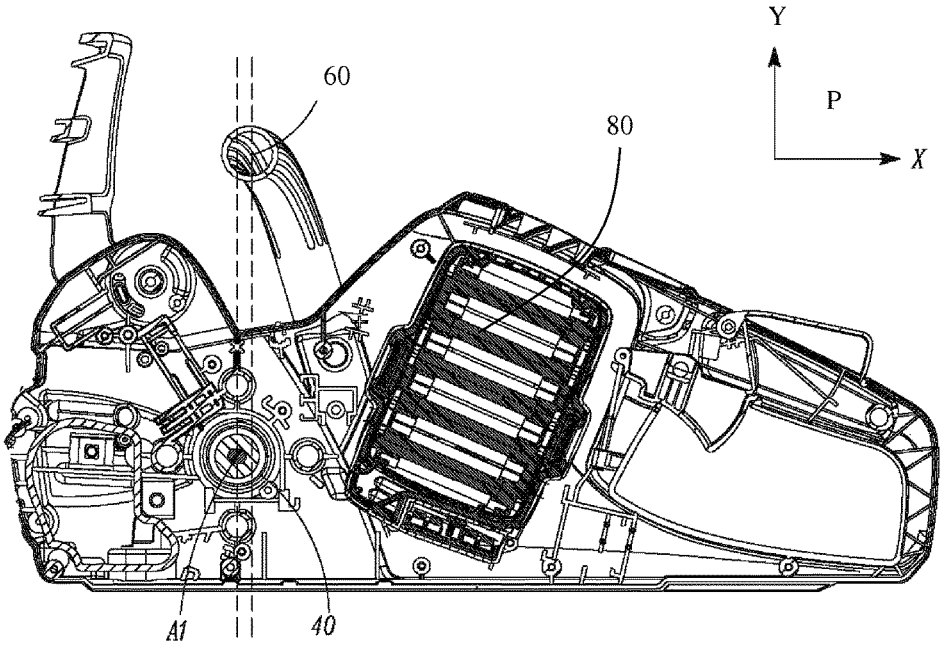
FIG. 3*a* is a partial cross sectional view taken along line X1-X1 in FIG. 2.

As shown in FIG. 3*a*, the body portion comprises a battery pack 80 which is arranged to supply electric power to an electric motor 40. The electric motor is also arranged in the body portion. The motor has a rotation axis A1. The motor rotation axis may extend in the Z direction, as in the embodiment shown in figures. The motor axis A1 may also extend in other directions.

The saw 1 has a longitudinal rotation axis X1, extending in the longitudinal direction X. In the embodiment shown in the figures, the vertical plane P comprising the longitudinal rotation axis X1 also comprises a longitudinal center line of the rear handle. In FIG. 3*a*, the vertical plane P is the plane of the paper.

The longitudinal center line is parallel with the extension direction of the guide bar. However, the guide bar may be displaced in the Z direction relative to the longitudinal center axis of the saw, such that the plane defined by the guide bar is parallel to but not coincident with the vertical plan P comprising the longitudinal rotation axis.

It has been noticed that a favorable distribution of masses within the chain saw may be achieved if the front handle 30 is positioned such that a point 60 in which the upper portion center axis A2 intersects the vertical plane P comprising the longitudinal rotation axis X1, is positioned rearwardly of a point 70 in which the motor rotation axis A1 intersects that vertical plane P.

Figure 3B:
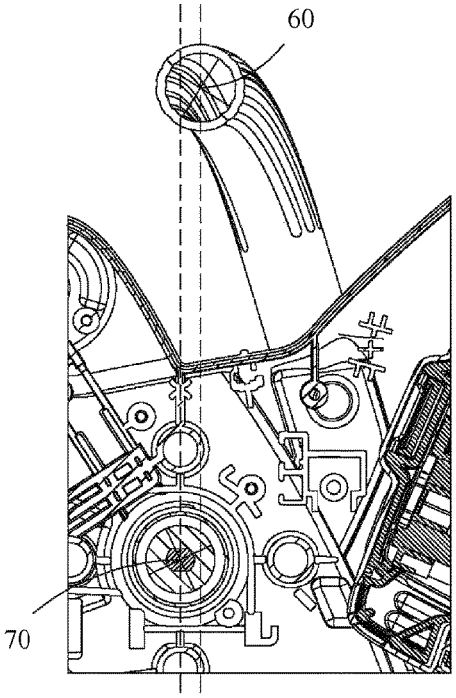
FIG. 3*b* is an enlarged view of a portion of the cross section shown in FIG. 3.

More specifically, a favorable distribution of masses within the chainsaw may be achieved if the front handle 30 and the motor rotation axis A1 are arranged so that the point 60 is located rearwardly of the point 70 as seen from above in FIG. 3*b*. Thereby the location of point 60 is defined by an X-coordinate that is greater than an X-coordinate of the location of point 70. As seen in FIG. 3*a* the X-direction is pointing in a rearward direction of the chainsaw and is generally parallel with a flat ground surface as the chainsaw is put away in an inoperable rest position.

By configuring and positioning the front handle in this way, the operator will experience that the chain saw is well balanced and comfortable to use, even if a fairly heavy battery pack is used.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A battery-powered chain saw, comprising:

a housing extending in a longitudinal direction between a front end and a rear end, a rear handle fixedly connected to or integral with the housing and extending in the longitudinal direction, a front handle comprising a first leg portion and a second leg portion, wherein the first and second leg portions are each non-movably fixedly connected to the housing, wherein the first leg portion is attached on a first side of a tool plane defined by the guide bar and the second leg portion is attached on a second side on the tool plane, and an electric motor disposed within the housing and arranged to drive a cutting element of the chain saw, the electric motor having a motor rotation axis, the chain saw having a longitudinal rotation axis, the longitudinal rotation axis being parallel to a bottom surface of the chain saw, wherein a first point in which a center axis of an upper portion of the front handle intersects a vertical plane comprising the longitudinal rotation axis of the chain saw, is positioned rearwardly of a second point in which the motor rotation axis intersects said vertical plane relative to the longitudinal rotation axis of the chain saw, wherein a battery is removably received within the housing perpendicular to the vertical plane comprising the longitudinal rotation axis and rearward of the upper portion of the front handle, and wherein the first point is positioned rearwardly of the second point and the battery is positioned rearward of the upper portion of the front handle to balance a distribution of mass of the battery-powered chain saw.

2. The battery-powered chain saw according to claim 1, wherein the vertical plane comprising the longitudinal rotation axis also comprises a longitudinal center line of the rear handle.

3. The battery-powered chain saw according to claim 1, wherein the vertical plane is essentially parallel with a main extension plane of a cutting element supporting guide bar extending from the front end of the housing.

4. The battery-powered chain saw according to claim 1, wherein the upper portion of the front handle extends in an essentially transversal direction of the chain saw.

5. The battery-powered chain saw according to claim 4, wherein the motor rotation axis extends in a direction which is essentially parallel with the transversal direction of the chain saw.

6. The battery-powered chain saw according to claim 1, wherein the upper portion of the front handle is angled relative to the transversal direction of the chain saw.

7. The battery-powered chain saw according to claim 1, wherein the battery is disposed between the first leg portion and second leg portion.

8. The battery-powered chain saw according to claim 1, wherein the battery is disposed rearward of the electric motor along the longitudinal rotation axis of the chain saw.

9. The battery-powered chain saw according to claim 1, wherein one leg portion connects forward of the electric motor and the other leg portion connects rearward of the electric motor along the longitudinal rotation axis of the chain saw.

10. The battery-powered chain saw according to claim 1, wherein the rear handle is disposed rearward of the battery along the longitudinal rotation axis of the chain saw.

11. The battery-powered chainsaw according to claim 1, wherein the direction of insertion of the battery is substantially parallel with a direction of extension of the first leg portion or the second leg portion connection to the housing.

12. The battery-powered chainsaw according to claim 1, wherein a top surface of the battery is substantially parallel with a top surface of the rear handle.

* * * * *